United States Patent [19]

Jarjavail et al.

[11] 4,156,300

[45] May 29, 1979

[54] FLOOR COVERING INSTALLATION

[75] Inventors: Jean-Claude Jarjavail, Pierre Chatel; Gilbert Palazzo, Vizille, both of France

[73] Assignee: Dinac S.A., Le Villaret de Susville, France

[21] Appl. No.: 841,354

[22] Filed: Oct. 12, 1977

[30] Foreign Application Priority Data

Oct. 15, 1976 [FR] France ..... 76 31096

[51] Int. Cl.[2] ..... A47G 27/04

[52] U.S. Cl. ..... 16/5; 16/16

[58] Field of Search ..... 16/1, 4, 5, 8, 16, 17, 16/7

[56] References Cited

U.S. PATENT DOCUMENTS

| | | | |
|---|---|---|---|
| 49,850 | 9/1865 | Blaisdell et al. | 16/7 |
| 778,742 | 12/1904 | Conner et al. | 16/4 |
| 913,159 | 2/1909 | Petrie et al. | 16/4 |
| 2,796,624 | 6/1957 | Speer | 16/16 |
| 3,543,326 | 12/1970 | Rohrberg et al. | 16/16 |
| 3,696,461 | 10/1972 | Kelly | 16/16 |

FOREIGN PATENT DOCUMENTS

| | | | |
|---|---|---|---|
| 1351446 | 5/1974 | United Kingdom | 16/7 |

*Primary Examiner*—Dorsey Newton

[57] ABSTRACT

A process for joining together the edges of two floor coverings, in which one web is positioned under the margin of one of the coverings and a corresponding wing is positioned over the margin of the covering, after which the wing is advanced towards the web so as to grip the margin of the covering between them, and the web is also advanced towards the wing, so as to grip the margin better.

7 Claims, 5 Drawing Figures

FLOOR COVERING INSTALLATION

The invention relates to floor covering installation and in particular to a profiled section for joining coverings on floors and walls, particularly at a door sill.

It is known to solve this problem by using a strip of domed cross section which is fixed to the floor or wall by screws and pads, the covering, such as a carpet, being compressed at its margins during the process.

But this involves drilling numerous holes in the support, for example the floor, damaging the floor and this is not in all cases desirable or even readily performed. Furthermore the screws can present sharp projecting edges which could be a source of danger to the user, particularly when carpets of different thicknesses are being joined. The screws go in at a slope and their holding power is impaired.

A known joining device for door sills is fixed in place by screws or nails and it has a cap with two wings projecting laterally from a central core. The device also has a base member with two lateral webs co-operating with the wings of the cap and having retainer claws. When the cap is pushed into the base member the wings of the cap approach the webs of the base member, clamping the margin of the carpet, for example, between the wings and the webs, the carpet being retained by the claws. A disadvantage of this arrangement is that carpets of greatly different thicknesses cannot be joined because the final gaps, between the wings of the cap and the webs of the base member, remain substantially equal at the two sides, being determined by the depth of penetration of the cap into the base member.

The invention removes these disadvantages by providing a floor covering installation, particularly for a door sill, which occupies little space, is easy to manufacture and install and is silent in use.

Broadly stated there is provided a floor covering installation in the form of a profiled section device for joining floor coverings, the installation comprising in combination a cap which has two lateral wings projecting outwards at either side from a central core; and a base member for receiving and retaining the core, the base member having two lateral webs which co-operate with the wings of the cap so that the inserted margins of floor coverings may be gripped between the wings and the webs and wherein the webs form a fork structure with arms which spread apart when a downward thrust is applied to the base member by means of the core, the thrust forcing the middle region of the base member down towards the subjacent support.

Figure 1:
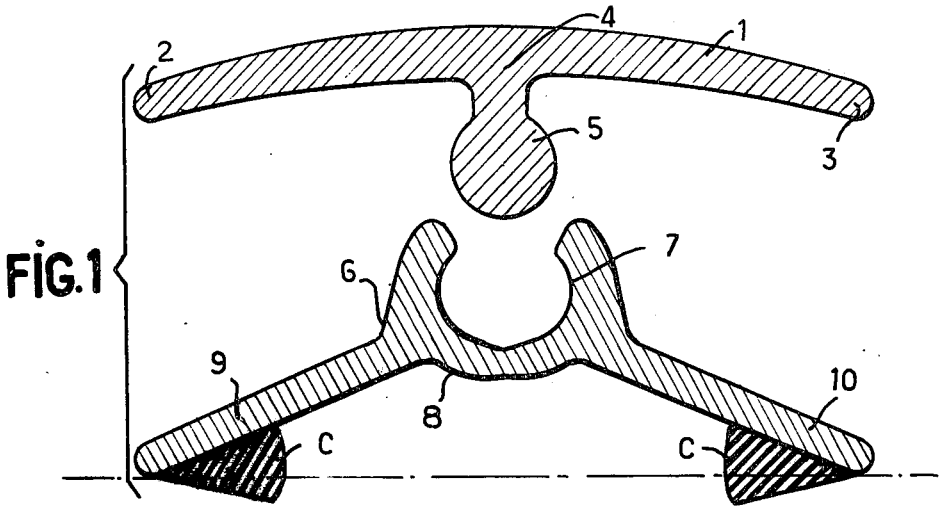
Figure 2:
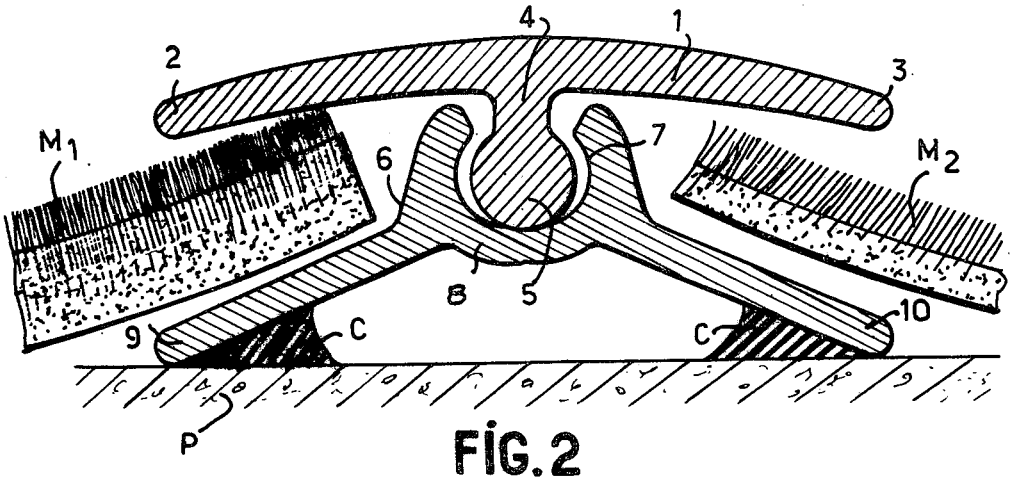
Figure 3:
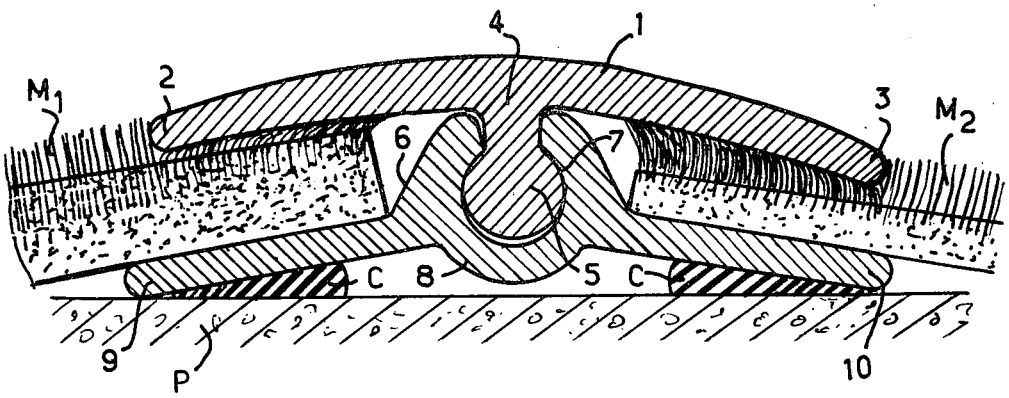
Figure 4:
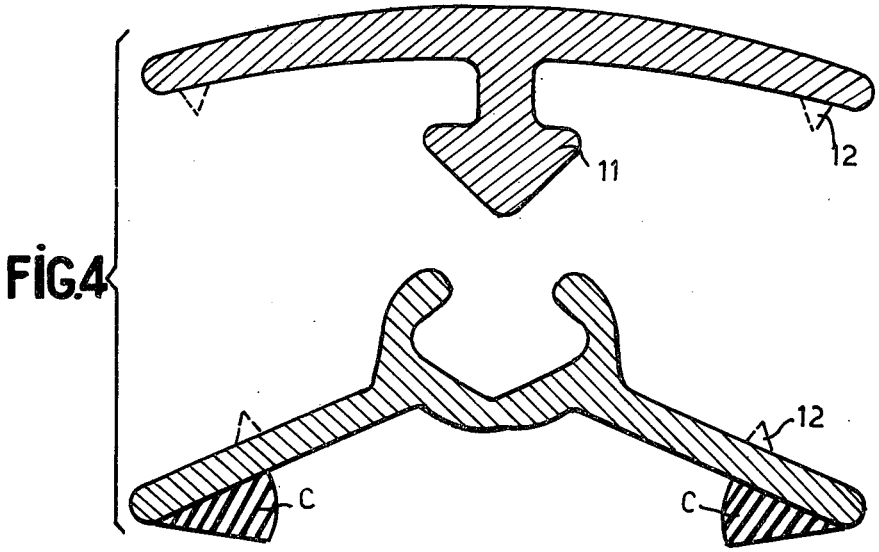
Figure 5:
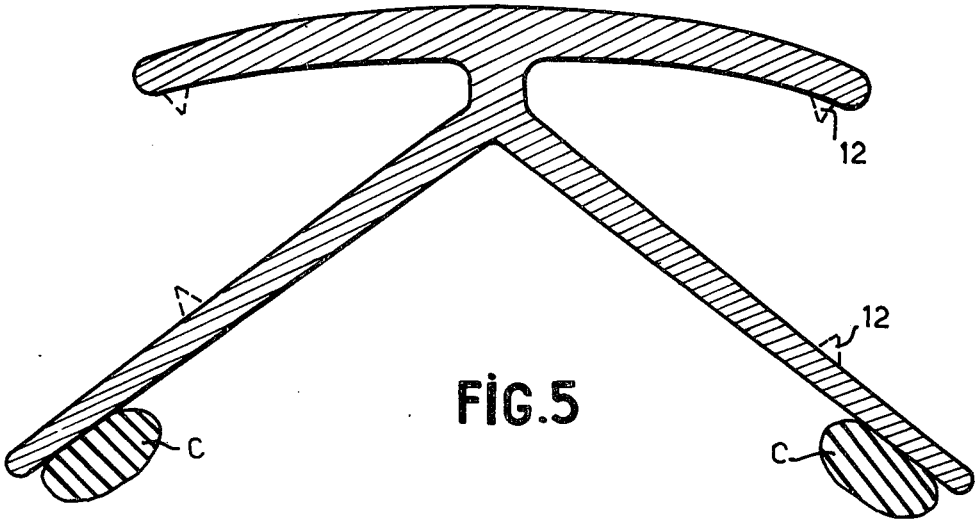

An example of the invention is illustrated in the attached drawing, in which:

FIGS. 1 to 3 are cross sections through a preferred version of the device according to the invention for joining coverings, the figures showing the device before, during and after installation; and FIGS. 4 and 5 show two variants.

The door sill comprises a cap 1 of profiled cross section, with two wings 2, 3 projecting laterally at either side from a central core 4 which has a downwards projection 5 of substantially spherical cross section. The wings 2, 3 are disposed symmetrically with respect to the core 4.

A base member 6, also of profiled cross section, has a throat 7 for receiving the projection 5.

The bottom 8 of the throat 7 is thinner in cross section than the side walls of the throat, and consequently is easier to deform.

Extending outwards at the two sides from the throat 7 are webs 9 and 10, giving the base member a forked structure. On its under surface, adjacent the outer edge, each web 9, 10 has a strip of adhesive substance C of a shape, in cross section, such that when the base member is thrust downwards, for example against a floor, the two webs come to adhere securely to the floor, the shape of each strip of adhesive substance ensuring that the adhesive substance flows inwards during this operation.

The strip C of adhesive substance is, before the base member is bonded to the floor, essentially triangular in cross section, being thicker towards the middle line of the device, and its under surface projects downwards to below the outer edges of the webs.

The adhesive substance should have a cohesion greater than 1 kg/cm$^2$ (shear-traction test) and it should not react with water or detergents over the temperature range $-15$ to $+80°$ C. Good results have been obtained with a butyl rubber and polybutene adhesive. The upper surfaces of the webs 9, 10 are opposite the lower surfaces of the wings 2, 3.

To install the device, one web 9 is positioned under the margin of the thicker carpet $M_1$ and pushed firmly against the floor, so that the adhesive substance grips the floor. The other web 10 comes under the margin of the thinner carpet $M_2$. The angle-lines between the central portion of the base member 6 and the webs can be used to guide the cutter in trimming the edges of the carpet. In the next operation, the spherical-sectioned projection 5 of the cap is inserted into the throat 7. A downward thrust applied to the cap 1 spreads the lateral webs 9, 10 outwards so that they approach the wings 2, 3, the throat closing on the spherical-sectioned projection 5 of the cap 1. This locks the two parts of the device together irreversibly, the webs and the wings between them gripping the margins of the two carpets of different thicknesses. It will be observed that during the gripping process the gradual deformation of the bottom 8 of the throat 7 allows the cap 1 to tilt to the degree necessary to compensate for the different carpet thicknesses, before the cap is finally locked irreversibly to the base member. During this operation the adhesive substance flows over the surface of the floor without becoming detached, and with increasing contact area with the floor.

In FIG. 4 the spherical-sectioned projection 5 is replaced by a projection 11 which has somewhat the shape, in cross section, of the fluke of an anchor, the base member 6 having a complementary shape.

In FIG. 5 the cap and the base member are made in one piece.

Claws 12 projecting from the joining surfaces of the wings 2, 3 and webs 9, 10 are provided, if necessary, to give a better grip on the carpets.

We claim:

1. A floor covering installation in the form of a profiled section device for joining floor coverings, the installation comprising:

a cap which has two lateral wings projecting outwards at either side from a central core and a central projection projecting downwards from the central core, a base-member having an upper throat in which the projection engages and two lateral webs projecting outwards at either side from the throat to form a fork structure wherein the throat has side sections and a bottom that is thinner in cross section than the side sections such that, when a downward thrust is applied to the base-member by means of the cap, the bottom is irreversibly deformed and shifted downwards with the side sections closing on the projection in the throat and the webs of the fork structure spreading apart respectively towards the wings so that inserted margins of the floor coverings are gripped between the wings and the webs.

2. A device as claimed in claim 1, and having strips of an adhesive substance pre-affixed to the under surfaces of webs adjacent their outer edges.

3. A device according to claim 2, wherein the lower surface of the adhesive strip projects downwards, before attachment of the device to the support, to below the outer edges of the webs.

4. A device according to claim 2, wherein the adhesive substance is such that it can flow, during attachment of the device to the support, without becoming detached from the support.

5. A device according to claim 1 wherein the projection which engages in the throat of the base member is of spherical cross section.

6. A device according to claim 5, in which the bottom of the throat is easier to deform than the remainder of the throat.

7. A device according to claim 1, in which the cap and the base member are each of one piece.

* * * * *